US006832538B1

(12) United States Patent
Hwang

(10) Patent No.: US 6,832,538 B1
(45) Date of Patent: Dec. 21, 2004

(54) FOAM SPONGE CUTTING APPARATUS WITH BOTH VERTICAL AND HORIZONTAL CUTTING DEVICES

(75) Inventor: Ber-Fong Hwang, 10F, No. 200, Jin-Shan S. Rd., Taipei (TW)

(73) Assignee: Ber-Fong Hwang, Taipei (TW)

( * ) Notice: Subject to any disclaimer, the term of this patent is extended or adjusted under 35 U.S.C. 154(b) by 0 days.

(21) Appl. No.: 09/478,677

(22) Filed: Jan. 6, 2000

(51) Int. Cl.[7] ..... B26D 1/50; B26D 1/553; B26D 53/04

(52) U.S. Cl. ..... 83/809; 83/651.1; 83/788; 83/813; 83/820

(58) Field of Search ..... 83/788, 808, 809, 83/813, 804, 805, 806, 789, 801, 820, 651.1

(56) References Cited

U.S. PATENT DOCUMENTS 2,150,426 A * 3/1939 Criner ..... 83/806
2,185,835 A * 1/1940 Criner ..... 83/805
2,654,404 A * 10/1953 Neuhauser et al. ..... 83/808
2,843,917 A * 7/1958 Crane ..... 83/801 X
3,350,970 A * 11/1967 Glastra ..... 83/820 X
3,800,650 A * 4/1974 Schroder ..... 83/789
4,111,085 A * 9/1978 Johnson ..... 83/813 X
4,683,791 A * 8/1987 Demont ..... 83/651.1 X
4,915,000 A * 4/1990 MacFarlane ..... 83/820 X
5,213,022 A * 5/1993 Elgan ..... 83/813 X
5,460,068 A * 10/1995 Gwosdz ..... 83/808 X
5,806,401 A * 9/1998 Rajala et al. ..... 83/808 X
6,125,733 A * 10/2000 Hwang ..... 83/788 X
6,199,468 B1 * 3/2001 Hackbarth et al. ..... 83/820
6,386,083 B1 * 5/2002 Hwang ..... 83/788

* cited by examiner

*Primary Examiner*—Clark F. Dexter
(74) *Attorney, Agent, or Firm*—Ware, Fressola, Van Der Sluys & Adolphson LLP

(57) ABSTRACT

Foam sponge cutting apparatus with both vertical and horizontal cutting devices. A vertical cutting device and a horizontal cutting device are disposed on the blade strip frame of the apparatus body. The horizontal cutting device can be moved up and down, while keeping in a horizontal state. By means of the horizontal cutting device, the foam sponge can be easily stably cut along horizontal cutting lines on the working bench. The vertical cutting device can be moved left and right, while keeping in a vertical state. By means of the vertical cutting device, the foam sponge can be cut into products with various irregular or curved shapes in vertical direction. therefore, one single foam sponge cutting apparatus can achieve both horizontally and vertically cutting effect.

6 Claims, 8 Drawing Sheets

FOAM SPONGE CUTTING APPARATUS WITH BOTH VERTICAL AND HORIZONTAL CUTTING DEVICES

BACKGROUND OF THE INVENTION

The present invention relates to a foam sponge cutting apparatus with both vertical and horizontal cutting devices. A vertical cutting device and a horizontal cutting device are at the same time disposed on the blade strip frame of the cutting apparatus. The blade strips are moved up and down, while keeping in a horizontal state or moved left and right, while keeping in a vertical state. By means of the vertical and horizontal cutting devices, the foam sponge or the like can be cut into products with various irregular or curved shapes in both vertical and horizontal directions.

A conventional foam sponge cutting apparatus uses a blade which cannot be moved so that the foam sponge can be cut only along a straight line. Also such foam sponge cutting apparatus lacks a blade deflection rectifying structure so that it is impossible to rust the blade in time and the cutting face is often unplane. Moreover, in case the blade becomes rusted or obtuse, it is quite difficult to replace the blade. In addition, in cutting, when it is desired to change the position of the horizontal blade strip, it is necessary to drive a control mechanism to shift the large and heavy structure body. This wastes a great amount of power.

SUMMARY OF THE INVENTION

It is therefore a primary object of the present invention to provide a foam sponge cutting apparatus with both vertical and horizontal cutting devices, in which the horizontal blade strip can be moved up and down, while keeping in a horizontal state so that the foam sponge block can be cut into products with various irregular or curved shapes in a horizontal direction. Therefore, the cutting operation can be speeded up to save cost.

It is a further object of the present invention to provide the above foam sponge cutting apparatus in which the vertical blade strip can be moved left and right, while keeping in a vertical state so that the foam sponge block can be cut into products with various irregular or cured shapes in a vertical direction. Therefore, the cutting operation can be speeded up to save cost.

It is still a further object of the present invention to provide the above foam sponge cutting apparatus in which by means of the pulley units, linear slide bars and guide rails, the movement of the blade strip can be accomplished by reversely synchronously sliding only a few elements. Therefore, it is no longer necessary to move the entire blade strip frame body, and thus the power consumption is lowered.

According to the above objects, the motor drives the transmission shaft to rotate and, via the thread rods, the left and right seat bodies of the blade turning unit are respectively synchronously moved along the linear slide bars and the guide rails of the linear slide bar seats. A guide wheel and a blade seat pulley respectively disposed on the two seat bodies are also synchronously moved along therewith to keep the working section of the blade strip moving up and down in a horizontal state or left and right in a vertical state. A blade strip deflection rectifying mechanism is able to automatically detect and rectify the deflection of the blade strip. The working surface is reciprocally linearly moved back and forth, and the positions of the foam sponge and blade strip on the plane are adjusted by means of numeral control so as to cut the foam sponge into products with various regular or curved shapes. A pneumatic cylinder serves to push the guide wheel to loosen the blade strip for easy replacement thereof. Therefore, the horizontal and vertical cutting operations are facilitated and stabilized and the power consumption is reduced, and thus the cost is lowered.

The present invention can be best understood through the following description and accompanying drawings, wherein.

DETAILED DESCRIPTION OF THE PREFERRED EMBODIMENT

Figure 1:
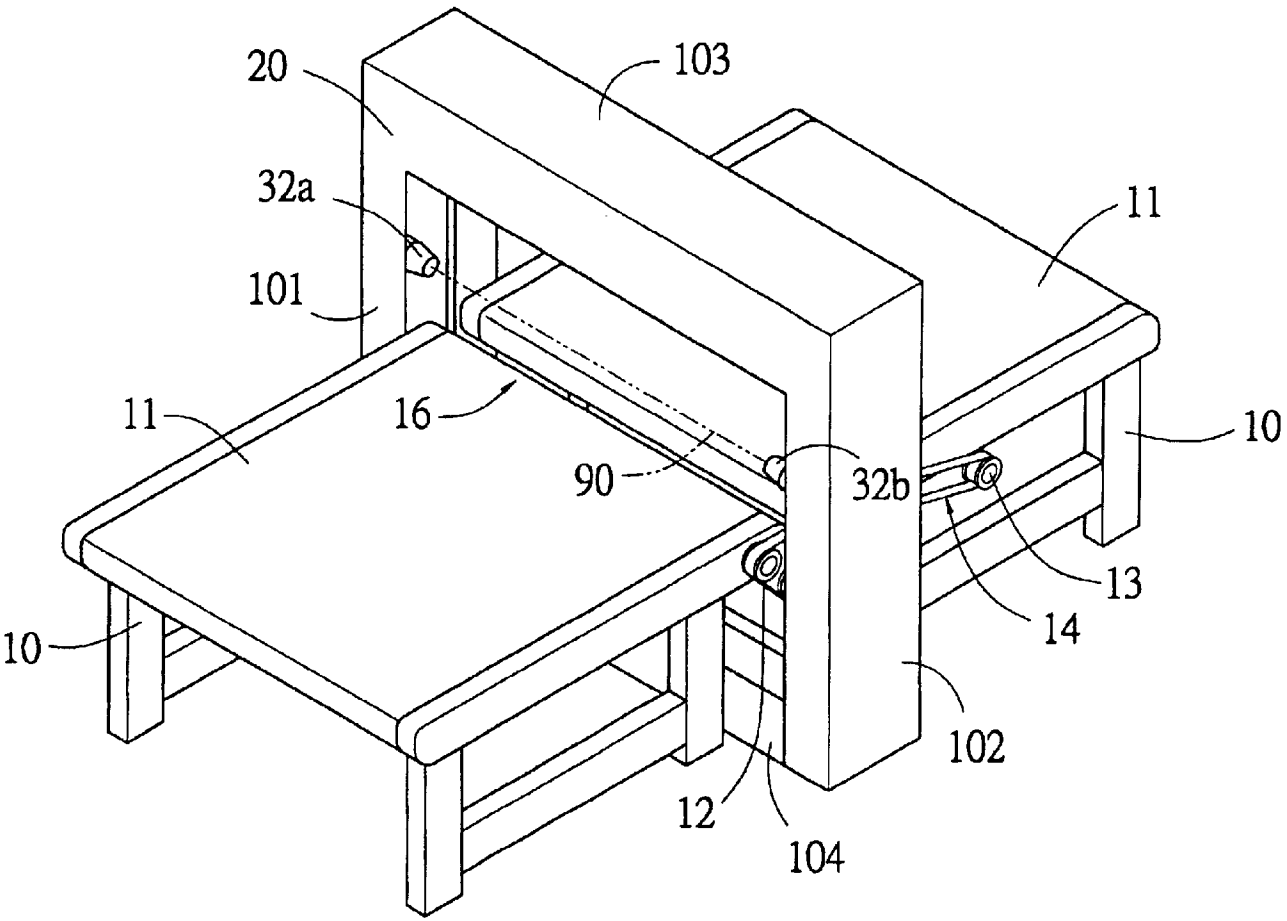
FIG. 1 is a perspective view of the foam sponge cutting apparatus of the present invention.
Figure 2:
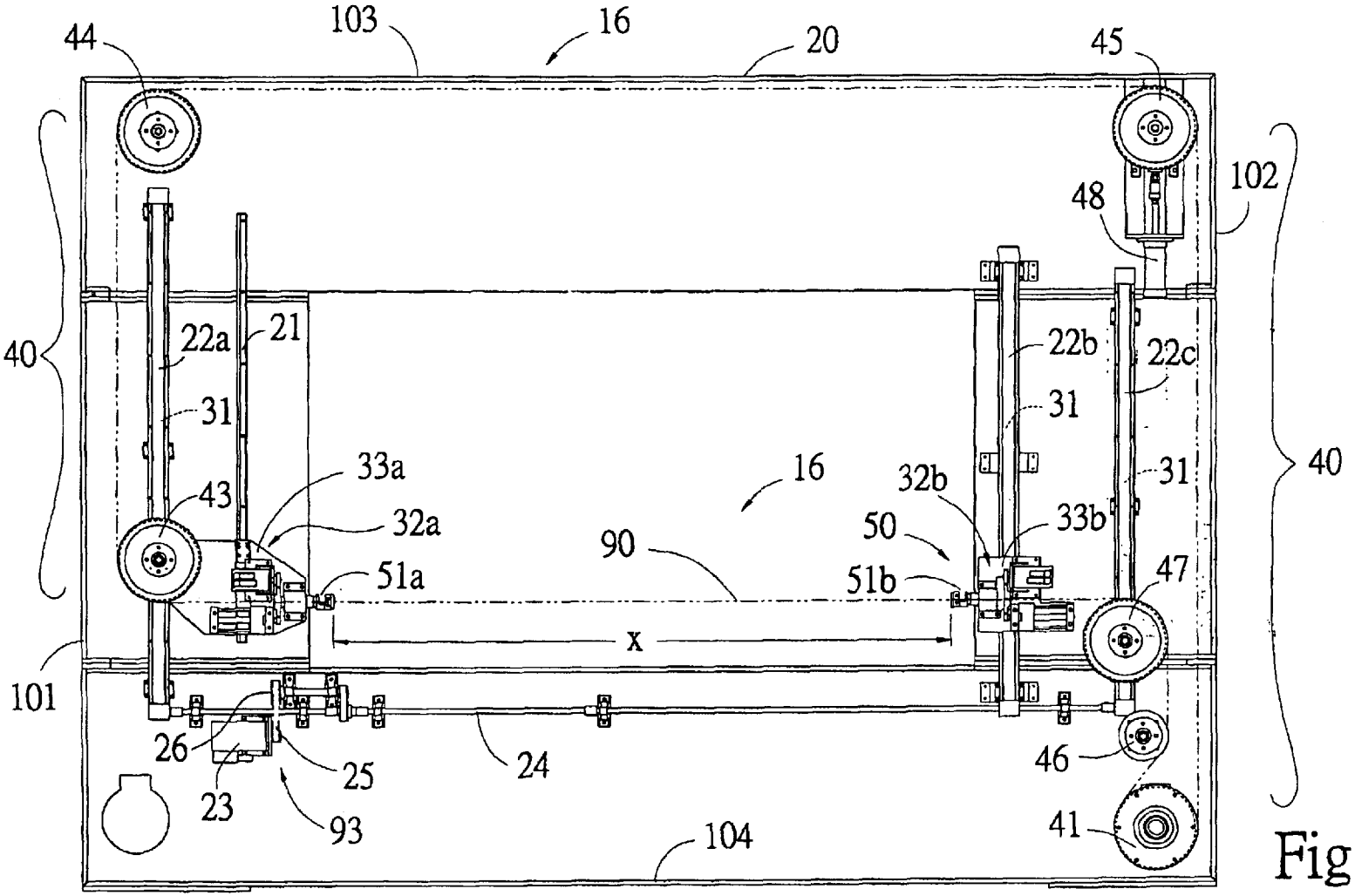
FIG. 2 is a front assembled view of the horizontal blade strip structure of the present invention in which the cover of the blade strip frame is opened.
Figure 3:
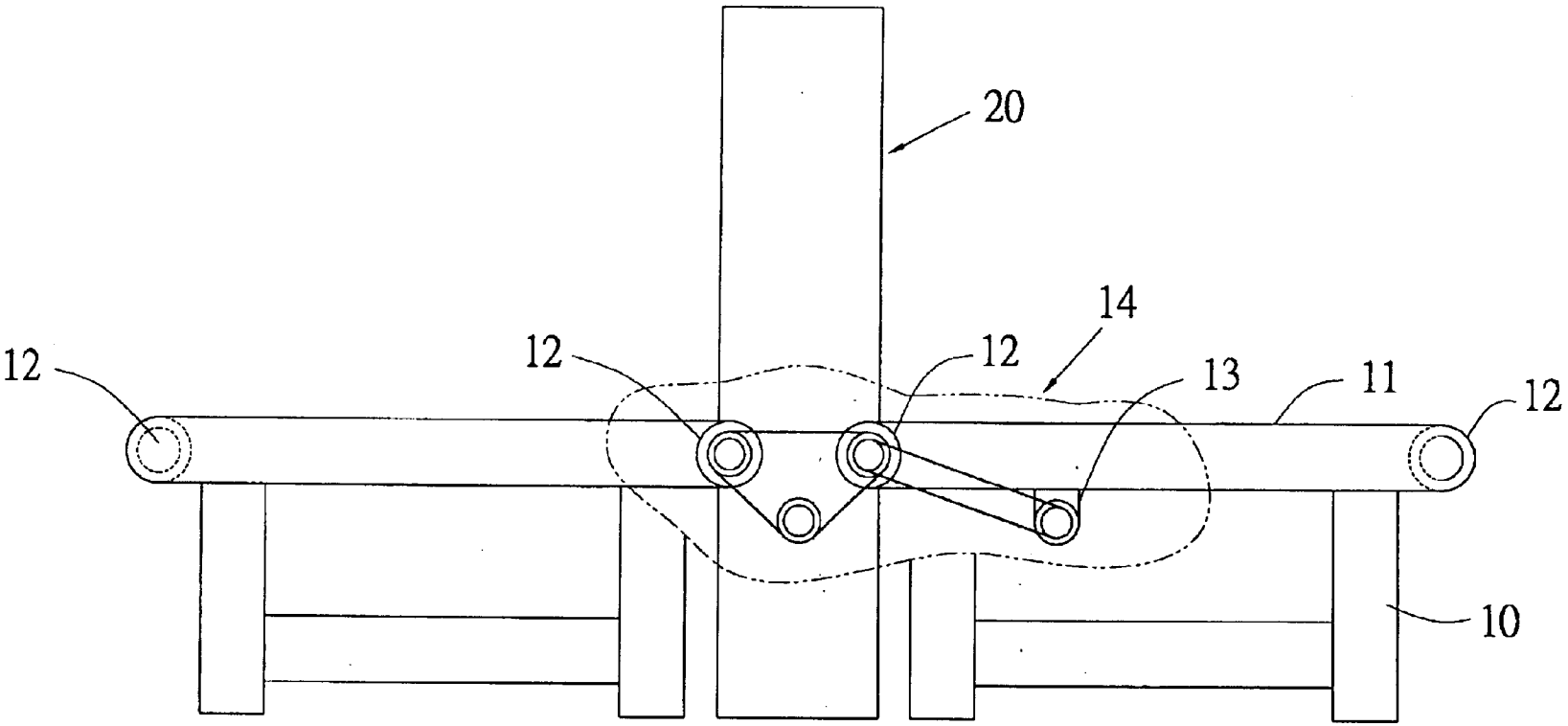
FIG. 3 is a side view of the working surface of the present invention.

Please refer to FIGS. 1 to 3. The present invention includes an apparatus body 10 and a blade strip frame 20 the blade strip frame 20 including a left column 101, a right column 102, an upper horizontal beam 103 and a lower horizontal beam 104. A working surface 11 is mounted on the apparatus body 10. A motor 13 is disposed under the working surface 11 and fitted with a toothed belt and wheel assembly 14. Two ends of each of the front and rear sections of the working surface 11 are disposed with roller shafts 12. The blade strip frame 20 is disposed with a horizontal cutting device 16. The left column of the horizontal cutting device 16 is disposed with a linear slide bar 22. A thread rod 31 is underlaid on the lower side of the slide bar 22. A guide rail 21 is disposed on the right side of slide bar 22 of the left column. The right column is disposed with two slide bars 22. A thread rod 31 is underlaid on the lower side of each of the slide bars 22.

A left blade turning unit 32 includes a left blade seat 33 and a right blade turning unit 32 includes a right blade seat 33. The right blade seat is hung on the slide bar 22, and the left blade seat is hung on the guide rail 21 and connected with the slide bar 22 on the left side.

Figure 4:
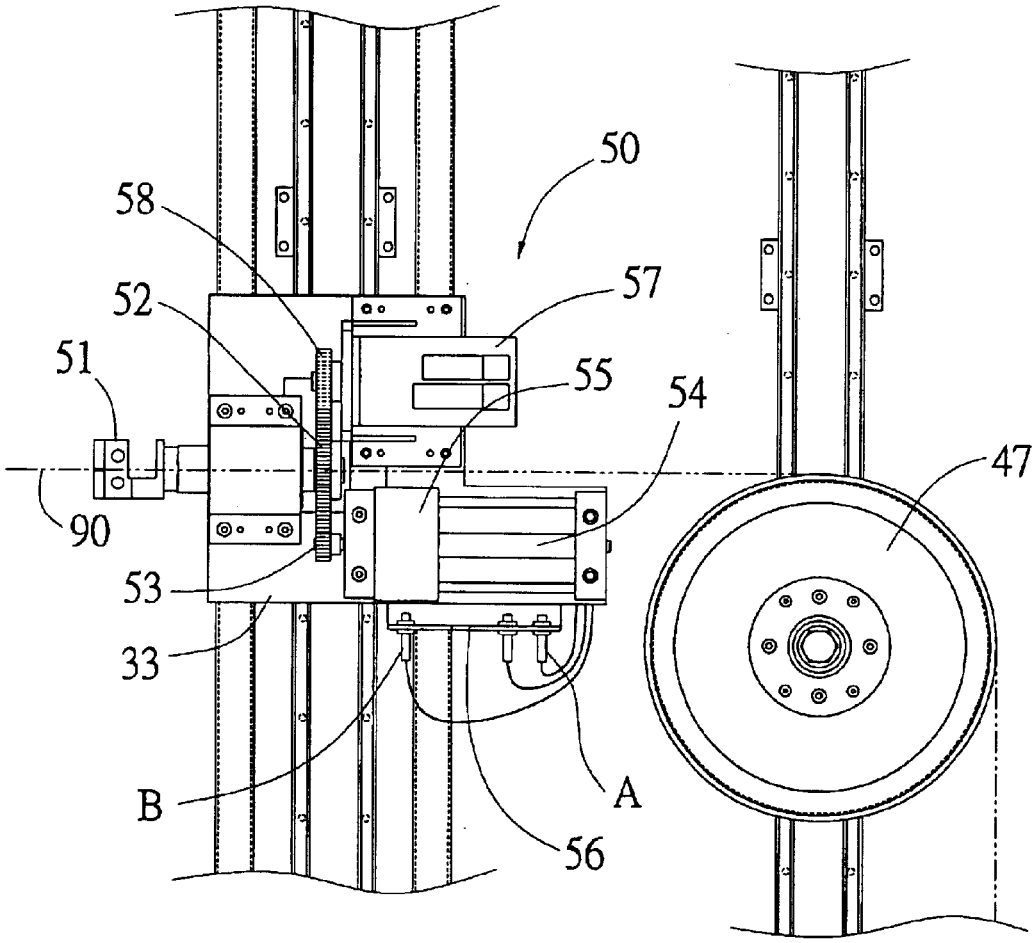
FIG. 4 is a plane assembled view of the blade strip deflection rectifying mechanism of the present invention.
Figure 5:
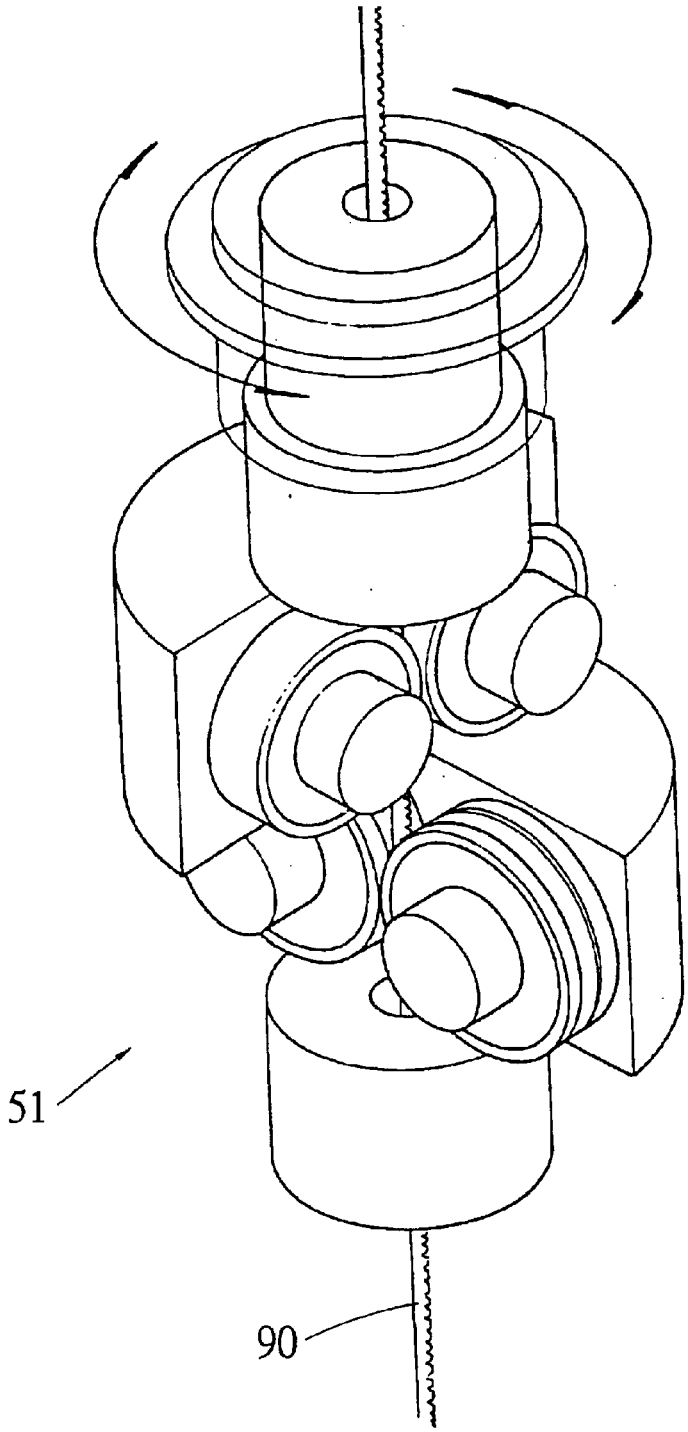
FIG. 5 is a perspective view of the blade strip deflection rectifying mechanism of the present invention.

Referring to FIGS. 2 and 4, a blade strip deflection rectifying mechanism 50 is disposed on the blade turning unit 32. The blade holder 51 at the front end is integrally connected with a first positive gear 52 for clamping a blade strip 90. Two gear teeth sections of the first positive gear 52 are respectively engaged with two positive gears 53, 58. A spiral rod 54 is engaged with the upper side of the second positive gear 53 and a slide block 55 is disposed on the spiral rod 54. A detector unit 56 is positioned beside the slide block 55, including an upper detector A and a lower detector B. The third positive gear 58 is disposed at the output shaft of a servomotor 57. As shown in FIGS. 4 and 5, when the blade face of the blade strip is turned by a certain angle, the blade holder 51 is also turned by a certain angle to make the first positive gear 52 rotate and indirectly drive the adjacent second positive gear 53 and the spiral rod 54 to rotate. Accordingly, the slide block 55 is vertically moved. When the turning angle of the blade strip 90 is responsive to the vertical moving height of the slide block 55 and exceeds the allowed limit of the upper detector A or lower detector B, the detector unit 56 will detect this and immediately activate the servo motor 57 to operate forward or backward in time for driving the third positive gear 58 to rotate and drive the first positive gear 52 to rotate. Accordingly, the blade holder 51 can carry the blade strip 90 and rectify the deflection to a correct angle. Therefore, the detector unit is a safety device for automatically sensing and automatically rectifying the deflection.

Referring to FIG. 2, a guide wheel unit 40 includes a driving wheel 41, a blade seat pulley 43 and four guide wheels 44, 45, 46, 47. The driving wheel 41 is mounted on the lower beam of the blade strip frame 20 and connected with an output shaft of a motor. The blade seat pulley 43 is disposed on the left side of the left blade seat of the blade turning unit 32 and positioned on the slide bar 22 and meshes with the thread rod 31 thereunder. The first and second guide wheels 44, 45 are mounted at two ends of the upper beam. The upper edges of the two wheels are adjacent to the tangential position. The third guide wheel 46 has a smaller diameter and is disposed on the upper side of the slide bar 22 of the right column and meshes with the thread rod 31 thereunder. A pneumatic cylinder 48 is vertically disposed on the lower side of the second guide wheel 45 and coupled therewith.

The blade strip 90 is wound over the driving wheel 41 and pulled upward to the second guide wheel 45. Then the blade strip 90 is tangentially pulled to the first guide wheel 44 and further pulled downward to the left blade seat pulley 43. Then the blade strip 90 horizontally passes through the left and right blade seats and is then pulled to the fourth guide wheel 47 and then pulled downward to the third guide wheel 46. Finally, the blade strip is pulled back to the driving wheel 41 to form a circularly winding space. The blade strip 90 includes a horizontal working section X and other sections forming the circularly winding space.

The blade turning unit movement control mechanism 93 includes a motor 23, the output shaft end of which, via a toothed belt 25 and a toothed pulley 26, is coupled with a transmission shaft 24. The left and right ends of the transmission shaft 24 are respectively vertically connected with the slide bars 22 and mesh with the thread rods 31 thereunder.

The present invention is characterized in that when the motor 23 outputs rotational power, the toothed belt 25 and the toothed pulley 26 are fitted with each other to drive the transmission shaft 24 to rotate. By means of the thread rods 31 under the respective linear slide bars 22, the left and right seat bodies 33 of the blade turning unit 32 are respectively reversely and synchronously moved along the slide bar 22 and the guide rail 21. The fourth guide wheel 47 and the blade seat pulley 43 are also guided by the thread rods 31 and synchronously reversely moved along therewith to keep the working section X of the blade strip 90 moving up and down in a horizontal state.

When the motor drives the driving wheel 41 to rotate, the blade strip 90 revolves continously by means of the transmission of a guide wheel unit 40 so as to provide a cutting effect on the working surface 11.

The pneumatic cylinder 48 pushes and displaces the second guide wheel 45 to change the circularly closed winding space of the blade strip so as to loosen the blade strip 90 for easy replacement thereof.

Figure 9:
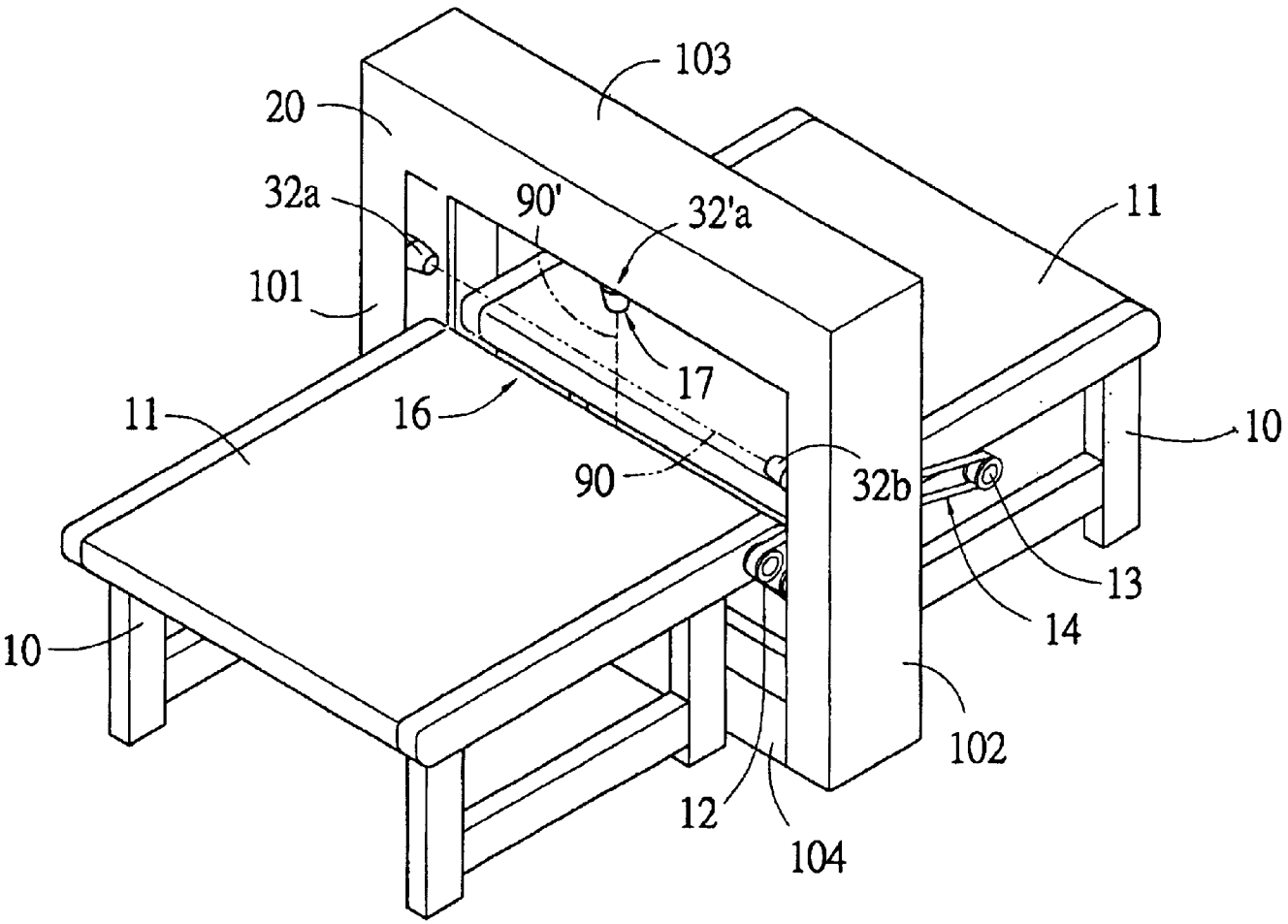
FIG. 9 illustrates the present invention, wherein both the horizontal and vertical cutting devices are shown.

In addition to the above horizontal cutting device 16, the other side of the blade strip frame 20 can be disposed with a vertical cutting device 17. The components of the vertical cutting device 17 are similar to those of the horizontal cutting device, while the guide wheel unit is installed in an altered direction. Therefore, one single cutting apparatus can provide both vertical and horizontal cutting functions. Such a cutting apparatus is shown in FIG. 9.

Figure 6:
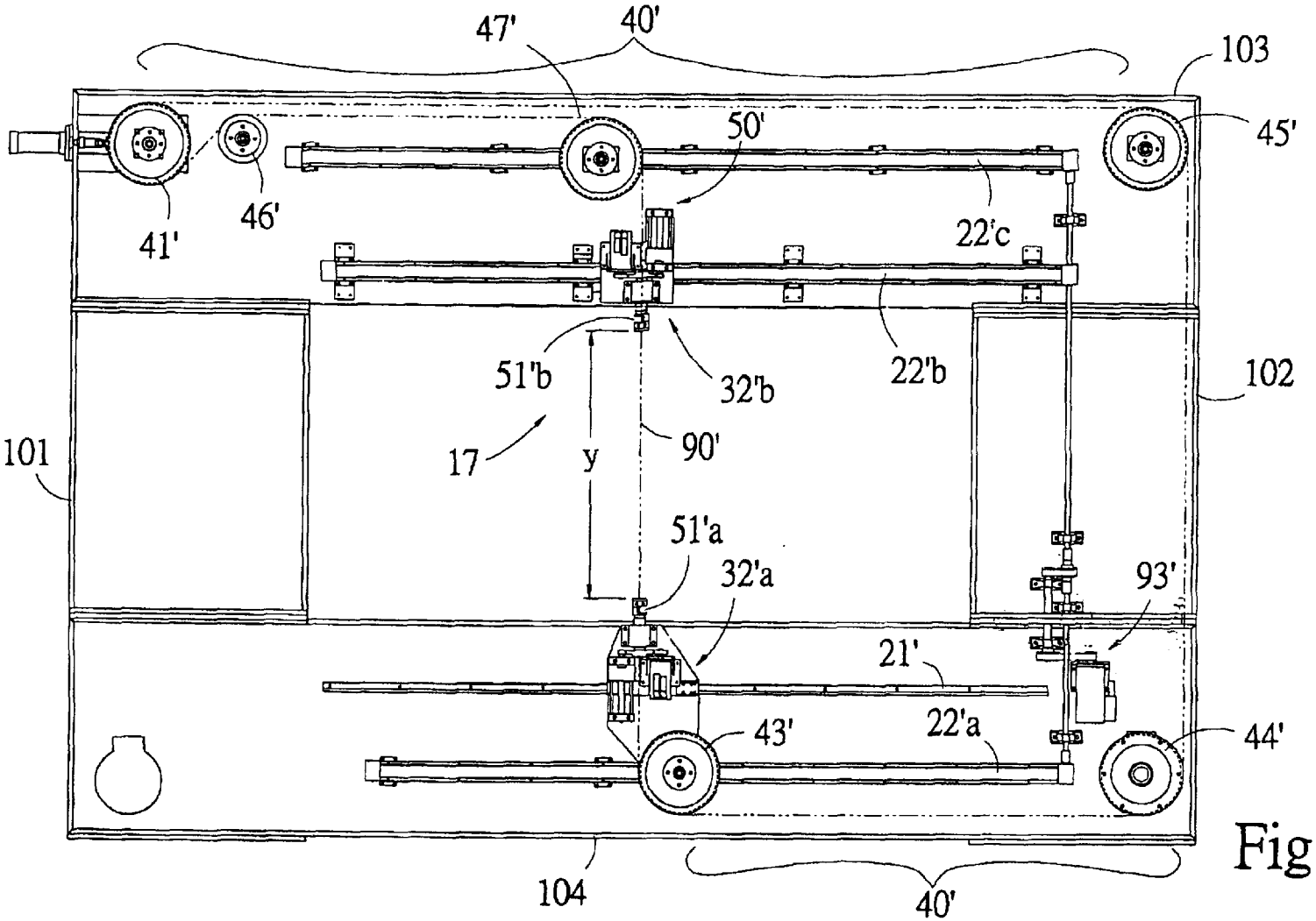
FIG. 6 is a front assembled view of the vertical blade strip structure of the present invention in which the cover of the blade strip frame is opened.

Referring to FIG. 6, the components of the guide wheel unit 40' of the vertical cutting device 17 are identical to those of the aforesaid guide wheel unit 40. As shown in FIG. 2, the entire structure of the vertical cutting device is alternatively arranged in a vertical state, in which the blade strip 90' is vertically positioned on the apparatus body 10, including a working section Y and other sections forming the circularly winding space. The blade turning unit 32', the blade strip deflection rectifying mechanism 50' and the blade turning unit movement control mechanism 93' of the vertical cutting device are also identical to those of the horizontal cutting device.

Figure 7:
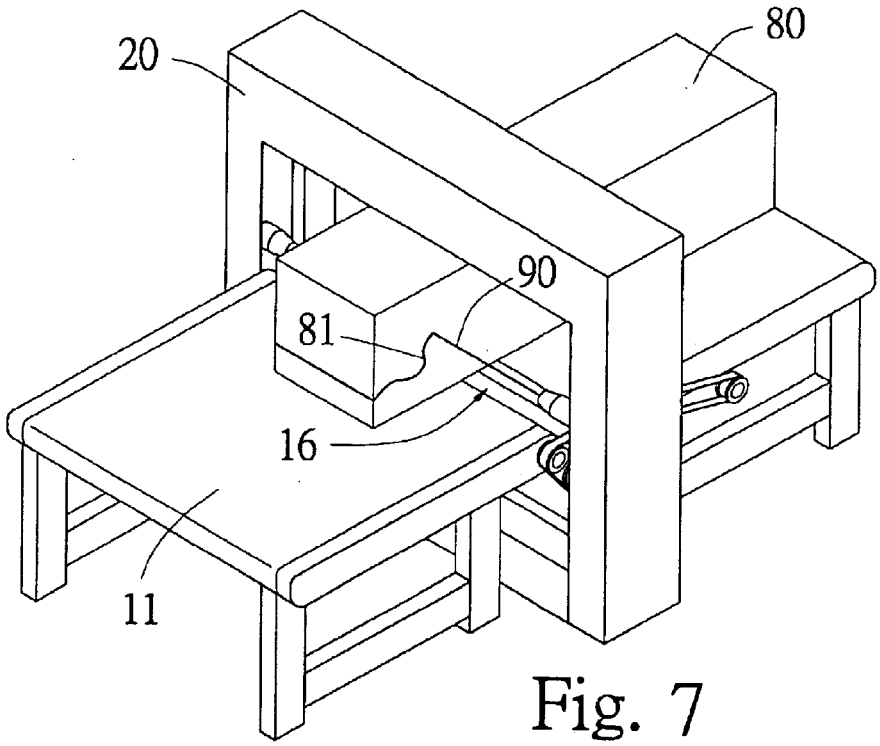
FIG. 7 shows the application of the present invention in one state.

Referring to FIG. 7, the foam sponge 80 is placed on the working surface 11 for a horizontally cutting operation, and then the horizontal cutting device 16 is activated. The working surface can be moved back and forth so as to cut the foam sponge along a various irregular or curved cutting line 81 in a horizontal direction. The travel of the blade strip 90 depends on the change of the position of the wheels of the guide wheel unit 40.

Figure 8:
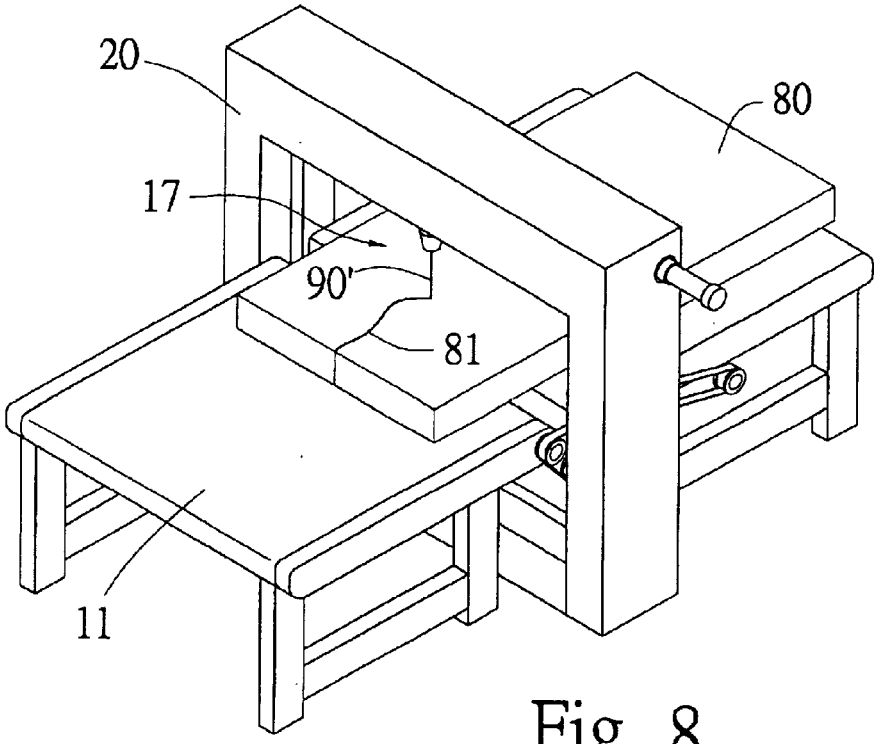
FIG. 8 shows the application of the present invention in another state.

Referring to FIG. 8, the foam sponge 80 is placed on the working surface 11 for a vertically cutting operation, and then the vertical cutting device 17 is activated to similarly cut the foam sponge along various irregular or curved lines in a vertical direction. Therefore, both vertical and horizontal cutting operations can be performed on one single working surface.

However, since both the vertical and horizontal cutting devices use the working surface, when using the horizontal cutting device 16, the vertical cutting device 17 should be shifted to one side to ensure safety. Both the vertical cutting device 17 having a blade strip 90', and the horizontal cutting device 16 having a blade strip 90 are shown in FIG. 9.

According to the above arrangement, the present invention has the following advantages:

1. The blade strip can be moved up and down in a horizontal state and the working surface is able to move the work piece so that the foam sponge can be cut into products with various irregular or curved shapes in a horizontal direction. Therefore, the cutting operation is facilitated and stabilized.
2. The blade strip can be moved left and right in a vertical state so that the foam sponge can be cut into products with various irregular or curved shapes in a vertical direction. Therefore, the cutting operation is facilitated and stabilized.
3. By means of the pulley unit, linear slide bars and guide rails, the shifting and changing of the interval of the blade strip can be accomplished only by sliding a few elements so that the power consumption is reduced and the working cost is lowered.

4. The pneumatic cylinder serves to push the guide wheel to loosen the blade strip for easy replacement thereof.

5. The guide thread rod is fitted with a connecting rod bearing so that the guide thread rod will not swing due to excessive length, and the stability is enhanced.

6. One single apparatus includes both vertical and horizontal cutting devices so that the apparatus can be very conveniently used.

The above embodiments are only used to illustrate the present invention, and not intended to limit the scope thereof. Many modifications of the above embodiments can be made without departing from the spirit of the present invention.

What is claimed is:

1. A foam cutting apparatus with a vertical blade strip (90') and a horizontal blade strip (90), comprising:

an apparatus body (10) having a working surface (11) linearly and reciprocally movable back and forth for moving a work piece placed thereon; and a frame (20) bridging over the apparatus body (10), the frame having two substantially upright columns defining first and second sides (101, 102) of the frame (20) and two transverse beams defining third and fourth sides (103, 104) of the frame (20), the two transverse beams connected between the two upright columns to define a substantially rectangular winding space for accommodating a vertical cutting device (17) and a horizontal cutting device (16);

the horizontal cutting device (16) comprising:

a first guide rail (21) disposed on the first side (101) of the frame (20), a first linear slide bar (22*a*) disposed on the first side (101) of the frame (20) and substantially parallel to the first guide rail (21), a second linear slide bar (22*b*) disposed on the second side (102) of the frame (20), a third linear slide bar (22*c*) disposed on the second side (102) of the frame (20) and spaced from and substantially parallel to the second linear slide bar (22*b*), a first blade turning unit (32*a*) movably engaged with the guide rail (21) and the first linear slide bar (22*a*), the first blade turning unit (32*a*) having a first blade seat (33*a*) mounting a first blade holder (51*a*), the first blade holder (51*a*) holding the horizontal blade strip (90) and defining one end of a working section (X) of the horizontal blade strip (90), wherein the first blade turning unit (32*a*) is capable of turning the working section (X) of the horizontal blade strip at a deflection angle when cutting an irregular or curved shape;

a second blade turning unit (32*b*) movably engaged with the second linear slide bar (22*b*), the second blade turning unit (32*b*) having a second blade seat (33*b*) mounting a second blade holder (51*b*), the second blade holder (51*b*) holding the horizontal blade strip (90) and defining the other end of the working section (X) of the horizontal blade strip (90), wherein the second blade turning unit is capable of turning the working section (X) of the horizontal blade strip along with the first blade turning unit (32*a*);

a first wheel set (40) including a first driving wheel (41) disposed near a corner between the second side (102) and the fourth side (104) of the frame (20), a first pulley (43) movably engaged with the first linear slide bar (22*a*), a second pulley (47) spaced from and independently mounted with respect to the second blade turning unit (32*b*) and movably engaged with the third linear slide bar (22*c*), and first and second guide wheels (44, 45) separately disposed adjacent to the first and second sides (101, 102) near the third side (103) of the frame (20), wherein the wheel set (40) is used for winding the horizontal blade strip (90) in a closed loop with a fixed length, and the first wheel set further includes a third guide wheel (46) disposed near the first driving wheel (41) for keeping the loop in tension, and wherein the first pulley (43) is connected to the first blade turning unit (32*a*) for moving the first blade turning unit (32*a*) along the guide rail (21) when the first pulley (43) is moved along the first linear slide bar (22*a*); and a first transmission mechanism (23, 24) operatively connected to the first and second pulleys (43, 47) and to the second blade turning unit (32*b*) for simultaneously moving the first and second pulleys (43, 47) and the second blade turning unit (32*b*), respectively, along the first, third and second linear slide bars (22*a*, 22*c*, 22*b*) so as to move the working section (X) up and down while maintaining the working section (X) substantially parallel to the working surface (11); and the vertical cutting device (17) comprising:

a second guide rail (21') disposed on the fourth side (104) of the frame (20), a fourth linear slide bar (22'*a*) disposed on the fourth side (104) of the frame (20) and substantially parallel to the second guide rail (21'), a fifth linear slide bar (22'*b*) disposed on the third side (103) of the frame (20), a sixth linear slide bar (22'*c*) disposed on the third side (103) of the frame (20) and spaced from and substantially parallel to the fifth linear slide bar (22'*b*), a third blade turning unit (32'*a*) movably engaged with the second guide rail (21') and the fourth linear slide bar (22*a*), the third blade turning unit (32'*a*) having a third blade seat (33'*a*) mounting a third blade holder (51'*a*), the third blade holder (51'*a*) holding the vertical blade strip (90') and defining one end of a working section (Y) of the vertical blade strip (90'), wherein the third blade turning unit (32'*a*) is capable of turning the working section (Y) of the vertical blade strip (90') at a deflection angle when cutting an irregular or curved shape;

a fourth blade turning unit (32'*b*) movably engaged with the fifth linear slide bar (22'*b*), the fourth blade turning unit (32'*b*) having a fourth blade seat (33'*b*) mounting a fourth blade holder (51'*b*), the fourth blade holder (51'*b*) holding the vertical blade strip (90') and defining the other end of the working section (Y) of the vertical blade strip (90'), wherein the fourth blade turning unit (32'*b*) is capable of turning the working section (Y) of the vertical blade strip (90') along with the third blade turning unit (32'*a*);

a second wheel set (40') including a second driving wheel (41') disposed near a corner between the third side (103) and the first side (101) of the frame (20), a third pulley (43') movably engaged with the fourth linear slide bar (22'*a*), a fourth pulley (47') spaced from and independently mounted with respect to the fourth blade turning unit (32'*b*) and movably engaged with the sixth linear slide bar (22'*c*), fourth and fifth guide wheels (44', 45') separately disposed adjacent to the fourth and third sides (104, 103) near the second side (102) of the frame (20), wherein the second wheel set (40') is used for winding the vertical blade strip (90') in a closed loop with a fixed length, and the second wheel set further includes a sixth guide wheel (46') disposed near the second driving wheel (41') for keeping the loop in tension, and wherein the fourth pulley (43') is connected to the third blade turning unit (32'*a*) for moving the third blade turning unit (32'*a*) along the second guide rail (21') when the fourth pulley (43') is moved along the third linear slide bar (22'*a*);

a second transmission mechanism (23', 24') operatively connected to the fourth and fifth pulleys (43', 47') and to the fourth blade turning unit (32'*b*) for simultaneously moving the fourth and fifth pulleys (43', 47') and the fourth blade turning unit (32'*b*), respectively, along the fourth, sixth and fifth linear slide bars (22'*a*, 22'*c*, 22'*b*) so as to move the working section (Y) left and right while maintaining the working section (Y) substantially perpendicular to the working surface (11).

2. The foam sponge cutting apparatus of claim 1, further comprising means (12, 13, 14) disposed on the body (10) and mechanically linked to the working surface (11) for moving the working surface (11) relative to the frame (20) for moving the foam sponge piece along a direction perpendicular to both the working section (X) of the horizontal blade strip (90) and the working section (Y) of the vertical blade strip (90').

3. The foam sponge cutting apparatus of claim 1, further comprising means (50) for limiting the deflection angle of the horizontal and vertical blade strips (90, 90') from deflecting out of a predetermined angular range.

4. The foam sponge cutting apparatus of claim 1, wherein the working section (Y) of the vertical blade strip (90') can be moved to the first side (101) or the second side (102) when the horizontal blade strip (90) is used to cut the foam sponge piece in the horizontal cutting direction.

5. The foam sponge cutting apparatus of claim 1, wherein the working section (Y) of the horizontal blade strip (90) can be moved to the third side (103) or the fourth side (104) when the vertical blade strip (90') is used to cut the foam sponge piece in the vertical cutting direction.

6. The foam sponge cutting apparatus of claim 1, wherein the horizontal cutting device further comprises:

a first thread rod (31) disposed in relation to the first linear slide bar (22*a*) and mechanically engaged with the first transmission mechanism (24) for moving the first pulley (43) along the first linear slide bar (22*a*);

a second thread rod (31) disposed in relation to the second linear slide bar (22*b*) and mechanically engaged with the first transmission mechanism (24) for moving the second blade turning unit (32*b*) along the second slide bar (22*b*); and a third thread rod (31) disposed in relation to the third linear slide bar (22*c*) and mechanically engaged with the first transmission mechanism (24) for moving the second pulley (47) along the third linear slide bar (22*c*).

* * * * *

UNITED STATES PATENT AND TRADEMARK OFFICE

CERTIFICATE OF CORRECTION

PATENT NO. : 6,832,538 B1
DATED : December 21, 2004
INVENTOR(S) : Hwang

It is certified that error appears in the above-identified patent and that said Letters Patent is hereby corrected as shown below:

Column 1,
Line 22, "rust" should be -- adjust --.

Column 2,
Line 9, "wherein" should be -- wherein: --.
Line 39, "20" should be -- 20, --.

Column 3,
Line 11, "55" should be deleted.

Column 8,
Line 7, "(y)" should be -- (x) --.

Signed and Sealed this

Thirty-first Day of May, 2005

JON W. DUDAS
*Director of the United States Patent and Trademark Office*